United States Patent [19]

Kurr

[11] 3,994,795

[45] Nov. 30, 1976

[54] SACRIFICIAL ANODE

[75] Inventor: George W. Kurr, Fair Lawn, N.J.

[73] Assignee: Federated Metals Corporation, New York, N.Y.

[22] Filed: Mar. 24, 1975

[21] Appl. No.: 561,127

Related U.S. Application Data

[63] Continuation-in-part of Ser. No. 384,186, July 31, 1973, abandoned, which is a continuation-in-part of Ser. No. 288,617, Sept. 13, 1972, abandoned.

[52] U.S. Cl. ..... 204/197; 204/280

[51] Int. Cl.[2] ..... C23F 13/00

[58] Field of Search ..... 204/147, 148, 196, 197, 204/280

[56] References Cited

UNITED STATES PATENTS

| | | | |
|---|---|---|---|
| 3,001,924 | 9/1961 | Battis et al. | 204/197 |
| 3,623,968 | 11/1971 | Bohne | 204/148 |
| 3,870,615 | 3/1975 | Wilson et al. | 204/197 |
| R27,529 | 12/1972 | Doremus et al. | 204/197 |

FOREIGN PATENTS OR APPLICATIONS

| | | | |
|---|---|---|---|
| 852,154 | 10/1960 | United Kingdom | 204/197 |

OTHER PUBLICATIONS

ASARCO Reprint from Federated Metals Digest, 1958, pp. 1 & 2, 204–197.

*Primary Examiner*—T. Tung

*Attorney, Agent, or Firm*—R. J. Drew; E. J. Schaffer

[57] ABSTRACT

Fracturing of arcuate anode segments per se or of an anode section of a sacrificial anode during installation of bracelet-type anodes about a pipeline to be cathodically protected is minimized. Distortion of the anode segment during cooling of the metal after casting the segment is also minimized. The minimizing of the distortion and fracturing of the anode segments is attained in certain embodiments of the invention, for a given pipeline of a certain diameter, by the arcuate-shaped anode segments each being of an arc length which is not above a predetermined maximum arc length in the range of about 14 inches to about 27 inches. The sacrificial anode assembly comprises an even-numbered plurality in the range of 4 to 8 of the arcuate-shaped anode segments secured about the pipeline in pipe-embracing relationship thereto, such plurality of anode segments being 4 anode segments for a pipeline of pipe diameter in the range of about 20 inches to about 36 inches, 6 anode segments for a pipeline of pipe diameter in the range of about 30 inches to about 54 inches, 8 anode segments for a pipeline of pipe diameter in the range of about 40 inches to about 72 inches, 4 or 6 anode segments for a pipeline of pipe diameter in the range of about 30 inches to about 36 inches, and 6 or 8 anode segments for a pipeline of pipe diameter in the range of about 40 inches to about 54 inches. The maximum arc length of each anode segment is determined prior to its casting and installation on the pipeline by the formula:

$$\text{Maximum arc length of anode segment} = \frac{\pi D}{n} - 2 \text{ inches}$$

wherein D is the diameter of the pipeline in inches and n is the total number of anode segments in the assembly.

13 Claims, 19 Drawing Figures

SACRIFICIAL ANODE

CROSS REFERENCES TO RELATED APPLICATIONS

This is a continuation-in-part of my co-pending U.S. Patent Application Ser. No. 384,186, filed July 31, 1973, now abandoned which in turn is a continuation-in-part of my U.S. Patent Application Ser. No. 288,617, filed Sept. 13, 1972, now abandoned.

BACKGROUND OF THE INVENTION

1. Statement of the Invention

This invention relates to cathodic protection of pipelines or the like and more particularly to improvements in the sacrificial anode of the bracelet type for embracing a pipeline or the like for cathodic protection of the pipeline, which improvements minimize or substantially minimize distortion of the anode segments during cooling after casting and also minimize or substantially minimize fracturing of the anode segments during installation about the pipeline. Additionally this invention is concerned with the improved sacrificial anode segment per se, the anode assembly and a method for the preparation of the anode segments.

2. Description of the Prior Art

Semi-cylindrical galvanic anode segments for embracing a pipeline for cathodic protection of the pipeline are known in the prior art and are disclosed in U.S. Pat. No. 3,616,422, reissued as Reissue U.S. Pat. No. 27,529. Although such anode segments give entirely satisfactory results in certain respects, one drawback of such semi-cylindrical segments is their tendency to become distorted during cooling of the metal after casting of the segments and also to fracture during installation about the pipeline, and this was particularly the case with the longer semi-cylindrical segments which are utilized with the larger diameter pipelines. The desideratum is to provide the curved anode segments with a curvature which closely approximates the curvature of the coated pipeline about which the anode segment is to be installed so that the curved segments will fit closely about the pipeline and it was, generally speaking, virtually impossible to cast a curved anode segment every time having a curvature closely approximating the curvature of the pipeline. And this was especially the situation when casting the longer anode segments for use about the large diameter pipelines. When the anode segment does not have sufficient curvature to correspond to that of the pipeline, it is necessary to bend end portions and/or other portions of the segment inwardly by application of pressure to obtain the necessary curvature to conform to and closely fit about the pipeline, and the pressure application required for the bending may result in cracking of the anode segment. Sometimes it is necessary to bend the curved anode segments outward by application of pressure to obtain the necessary curvature to closely fit about the pipeline and this pressure application may also result in cracking of the segment. Cracking of the sacrificial anode metal of the segment is undesirable for the reason a crack or cracks in the sacrificial anode metal may expose the cathodic core metal of the anode, which is embedded within the sacrificial anode metal. Consequently, after installation and exposure of the cathodic core metal to the electrolyte due to the crack or cracks in the anode metal, the anode expends itself of sacrificial anode metal to protect the core metal with the resultant inefficiency and wasting of sacrificial anode metal. Notches have been provided in the aforementioned prior art semi-cylindrical anode segments for promoting cracking at the center of the segment.

The publication "Cathodic Protection of Submarine Pipeline," reprinted from the Federated Metals Digest of the American Smelting and Refining Company, Federated Metals Division, published 1958, discloses a sacrificial anode assembly wherein the anode segments are indirectly connected together by the steel cores of the anodes being welded to steel bands. The major axis of the cores of the anodes are parallel to the major axis of the pipe, and the cores extend from that portion of the anode which are the side edges of the anode.

Heretofore non-arcuate shaped anode segments have been heated and then bent in the heated condition to fit the segment about the shaft housing of a marine propeller. The anode segments were welded to non-anodic housing structural members and were not connected to one another about the housing. The problem is that when the anode segments are of zinc or zinc base alloy the segments tend to crack during the bending at ambient temperature due to the brittle nature of the zinc. Arcuate-shaped anode segments have also been cast heretofore and bolted about the shaft housing of a marine propeller. Again the segments were not connected to one another about the housing.

OBJECTS OF THE INVENTION

One object of this invention is to provide new and improved sacrificial anodes of the bracelet type for cathodically protecting pipelines or the like.

Another object of this invention is to provide new and improved sacrificial anode segments in which distortion of the segment is minimized or substantially minimized during cooling of the segment after the casting thereof.

A further object is to provide new and improved arcuate-shaped sacrificial anode segments in which fracturing of the segment is minimized or substantially minimized during installation of the segment about a pipeline or the like.

An additional object is to provide new and improved anode sections or anodes comprising a plurality of arcuate-shaped anode segments, and one or more metal cores common to all the segments, and in which fracturing of the segments is minimized during installation of the anode about a pipeline or the like and distortion of the segments is minimized during cooling of the segment anode metal after casting thereof.

A further object is to provide new and improved anode sections which facilitate installation of the bracelet-type anode on the pipe by eliminating the requirement of forming joints between each pair of adjacent anode segments by welding overlapping core bars.

Still another object is to provide methods for the preparation of the arcuate-shaped sacrificial anode segments and anode sections.

Additional objects and advantages will be readily apparent as the invention is hereinafter described.

The terms "fracturing" and "fracture" are used herein in a broad sense to mean cracking of the anode segment with or without exposure of the cathodic core metal of the anode segment, and/or breaking of the anode segment into pieces or fragments. The terms "pipe diameter" and "diameter of the pipe" are used herein to mean the diameter of the pipeline pipe having the anit-corrosive coating thereover, as contrasted with the negative buoyancy-providing concrete layer over the pipe, with the diameter terminating at each end at the external surface of the anti-corrosive coating. The term "arc length" or "arc lengths" used herein with respect the arcuate anode segment or segments means the length or lengths of the arcuate anode segment or segments measured on the inner periphery of the segment. The term "arc length" used herein with reference to the length of the mold cavity means the length of that arc of the mold cavity which forms a portion of an imaginary circle which is the closest to the center of such circle.

BRIEF SUMMARY OF THE INVENTION

In accordance with the present invention, fracturing of the arcuate segments of galvanic anode metal during installation of the arcuate anode segments, either as the segments per se or when forming a portion of an anode section or sections, about a pipeline is minimized or substantially minimized. Distortion of the arcuate anode segments during cooling of the metal after casting due to naturally occurring stresses in the metal is also minimized or substantially minimized in accordance with the present invention and, as a result of the minimizing of distortion of the arcuate segments, the curvature of the segments corresponds more closely to that of the pipeline and a closer fit is obtained of the segments about the pipeline without having to bend end portions or other portions of the segments inwardly or outwardly significantly and a sufficient extent by pressure application to give a close fit with attendant fracturing of the segments. The means by which I accomplish the minimizing of the distortion of the anode segments during cooling of the metal after casting and the minimizing of the fracturing of the anode segments during their installation about the pipeline are disclosed hereinafter.

I have found in accordance with the present invention that the aforementioned objects and improvements are attained by arcuate anode segments each of an arc length which is not above a predetermined maximum arc length in the range of about 14 inches to about 27 inches, and that the strict observance of the predetermined maximum arc length of the anode segment for a given diameter pipeline is critically important for minimizing or substantially minimizing fracturing of the anode segment during installation about the pipeline and distortion of the segment during cooling of the metal after casting. The anode segments of this invention can be of any desired arc length so long as their arc length does not exceed the predetermined critical maximum arc length.

The sacrificial anode assembly of the present invention for the cathodic protection of pipelines or the like comprises a corrosible metallic pipeline having a diameter in the range of about 20 inches to about 72 inches disposed in an electrolyte, and a sacrificial bracelet-type anode secured about the pipeline in pipe-embracing relationship thereto. The anode comprises an even-numbered plurality in the range of 4 to 8 arcuate-shaped anode segments of a sacrificial anode metal connected about the pipeline in pipe-embracing relationship thereto. This plurality of anode segments is critically 4 anode segments for a pipeline of pipe diameter in the range of about 20 inches to about 36 inches, 6 anode segments for a pipeline of pipe diameter in the range of about 30 inches to about 54 inches, 8 anode segments for a pipeline of pipe diameter in the range of about 40 inches to about 72 inches, 4 or 6 anode segments for a pipeline of pipe diameter in the range of about 30 inches to about 36 inches and 6 or 8 anode segments for a pipeline of pipe diameter in the range of about 40 inches to about 54 inches. Each anode segment comprises one or more metal cores cathodic to the anode metal concentrically embedded entirely within the anode metal except for portions of the core extending from opposite end edges of the anode segment. The anode segments are directly connected together in pipe-embracing relationship about the pipe by one or more joints formed at end edges of the core. Means are provided for minimizing fracturing of the anode segments during installation of the anode about the pipe and also for minimizing distortion of the anode segments during cooling of the metal after casting, the anode segment fracturing-and distortion-minimizing means being a predetermined maximum arc length of each anode segment which is critically in the range of about 14 inches to about 27 inches. The maximum arc length of each anode segment of this invention in the range of about 14 inches to about 27 inches is determined by the formula:

$$\text{Maximum arc length of anode segment} = \frac{\pi D}{n} - 2 \text{ inches}$$

wherein D is the diameter in inches of the pipeline to be cathodically protected, $n$ is the total number of anode segments in the assembly, and $\pi$ has its usual value of 3.1416.

The minimum arc length of the arcuate-shaped anode segments of this invention is not critical and the anode segments herein can be any of desired arc length so long as the arc length does not exceed the predetermined maximum arc length as is hereinbefore disclosed.

In an additional embodiment of the invention, in an anode section or anode of this invention, one or more metal cores are embedded within the anode metal of a plurality of arcuate shaped segments of sacrificial anode metal of an anode section, the metal core or cores being common to all of the segments of each anode or anode section. The common core or cores which are of metal cathodic to the anode metal, have end portions extending from end edges of the segment disposed on opposite end portions of such core or cores, for forming joint elements for connecting this anode together with adjacent anodes or anode segments about a pipeline or the like in pipe-embracing relationship. Means are also provided for minimizing fracturing of the anode segments during installation of the anode. This embodiment having the core or cores common to and embedded within a plurality of the anode segments facilitates installation of the anode about the pipeline or the like for the reason joints do not have to be welded between all adjacent anode segments, and the number of joints that have to be formed is materially reduced.

In the last-mentioned embodiment, the length of the common core or cores of the anode section is preferably not in excess of about one-half the outer circumference of the pipe or pipeline or the like. The reason for this is to facilitate assembly of the anode about the pipe or pipeline. When the length of the arcuate common core or cores is materially greater than one-half the outer circumference of the pipeline it may be difficult to position the anode about the pipeline for installation, or it may be necessary to bend the opposite end portions of the common core or cores outwardly to give clearance for positioning the anode about the pipeline or inwardly to give a close fit about the pipeline. And the bending of the common core or cores may be difficult due to being formed of usually a ferrous metal such as steel. If desired, however, the length of the common core or cores can be materially greater than one-half the outer circumference of the pipeline. Indeed the length of the common core or cores can range up to the outer circumference of thereabout of the pipe or pipeline or the like, if one does not object to having to bend the cores. With the last-mentioned length of the common core or cores, only a single joint would have to be formed.

In the anode section of the last-mentioned embodiment, to minimize or substantially minimize fracturing of the anode segments during their installation about the pipeline and distortion of the segments during cooling of the metal after casting, the arc length of each of the anode segments should not exceed the predetermined critical maximum arc length as is previously disclosed herein.

The method of the present invention for preparation of the arcuate-shaped anode segments comprises melting the sacrificial anode metal, e.g. zinc, magnesium, aluminum, or alloy thereof, and feeding or supplying the molten anode metal into the cavity of a suitable mold, for instance of ferrous metal, which is ordinarily preheated and wherein the cavity is of the shape and configuration corresponding to that of the arcuate-shaped anode segment desired. One or more metal cores which are of metal cathodic to the anode metal, e.g. steel, and which ordinarily have been preheated are previously positioned and secured in the mold cavity with the opposite end portions of the cores protruding from the opposite ends of the mold cavity. The metal core or cores are secured in the proper position in the mold cavity by their end portions extending through tight fitting openings in the opposite end of the mold and formed by the mold halves. The metal in the mold cavity is cooled, ordinarily by being allowed to cool to below its melting point, which is for example 419.4° C. in the case of zinc, or to below its solidus to solidify the molten metal, and the anode segment is essentially provided in accordance with this invention, during or after such casting in the mold, which is usually of ferrous metal, e.g. cast iron, with means for substantially minimizing distortion of the anode segment during cooling of the metal after the casting and substantially minimizing fracturing of the anode segment during the ultimate installation thereof. The solidified anode metal casting having the metal core or cores embedded therewithin and extending from opposite ends thereof is separated from the mold cavity.

In one embodiment of the method of the present invention for preparation of the arcuate-shaped anode segments, the method comprises melting the sacrificial anode metal, and feeding the molten anode metal into the cavity of the mold of corresponding configuration and shape as that of the arcuate-shaped anode segment desired and of a predetermined maximum arc length as is previously disclosed herein which is insufficient to result in distortion of the segment during cooling of the metal after this casting. The mold is usually preheated prior to supplying the molten anode metal therein. One or more metal cores cathodic to the anode metal, which are usually preheated, are positioned and secured in the mold cavity usually prior to feeding the molten anode metal into the mold, with the end portions of the metal core or cores extending from the opposite ends of the cavity through tight fitting openings formed by the two mold halves. The metal in the mold cavity is then cooled to below its melting point or solidus to solidify the molten metal. The solidified casting of anode metal having the metal core or cores embedded therewithin and protruding from opposite ends of the casting is thereafter separated from the mold cavity.

In an additional embodiment of the method of this invention for preparation of the arcuate-shaped anode segments, the method comprises melting the sacrificial anode metal and supplying the molten anode metal into the cavity of the mold, with the mold cavity being of a configuration and shape corresponding to that of the arcuate-shaped anode segment desired and with the mold cavity having an arc length not above the predetermined critical maximum arc length. The mold is usually preheated prior to feeding the molten anode metal therein. The mold has one or more metal cores cathodic to the anode metal which are usually preheated and which are positioned and secured in the mold cavity usually prior to feeding the anode metal into the mold, with the end portions of the metal cores extending from the ends of the cavity. The metal in the mold cavity is then cooled to below its melting point or solidus to solidify the molten metal, and the solidified casting of anode metal having the metal core or cores embedded therewithin and protruding from opposite ends of the casting is separated from the mold cavity.

In the preparation method of this invention for preparing the anode section comprising the plurality of spaced-apart arcuate-shaped anode segments, and the core or cores concentrically embedded within the segment anode metal and common to all of the anode segments of the section, the sacrificial anode metal is melted, and the molten anode metal fed into the cavity of a mold. One or more metal cores cathodic to the anode metal are properly positioned in the mold cavity usually prior to feeding the molten anode metal into the mold with the relatively short end portion of the core or cores protruding from one end of the mold cavity, and a relatively long portion of the core or cores protruding from the opposite end of the mold cavity. The molten anode metal is then fed into the mold cavity, and the melt in the mold cavity is thereafter cooled to below its melting point, ordinarily by being allowed to cool to below its melting point, to solidify the molten metal. The solid anode segment having the metal core or cores embedded therewithin is then separated from the mold cavity, after which the protruding relatively long remaining portion of the core or cores is moved or shifted over the desired extent and again properly positioned in the mold cavity prior to feeding the molten anode metal into such cavity, with the cast, solidified anode segment and its core or cores extending from one end of the mold cavity, and a relatively short end portion of the core or cores protruding from the opposite end of the mold cavity. The molten anode metal is then fed into the mold cavity after which the melt in the mold cavity is cooled to below its melting point, ordinarily by being permitted to cool to below its melting point, to solidify the molten anode metal. If only two anode segments are desired in the anode section, the anode segment with the common core or cores is then removed from the mold cavity and no more casting is required. However, if more than two anode segments are required in the anode section, the shifting and casting procedure disclosed immediately above is repeated one or more times to provide the number of anode segments desired in the anode section. Of course the core or cores utilized has to be of sufficient length to accommodate the number of anode segments to be cast thereon.

Alternatively, the anode section can be prepared by employing a plurality of molds with the number thereof corresponding to the number of anode segments desired in the anode section. The common core or cores are then properly positioned in the mold cavities of the properly spaced molds, after which the molten anode metal is fed into all the mold cavities. The molten metal is then cooled to below its melting point, ordinarily by being allowed to cool to below its melting point. The cast solidified anode section is then removed with its common core or cores from the mold cavities. In this alternative embodiment for preparing the anode sections, the metal core or cores extend from opposite end portions of the spaced apart molds through tightly fitting openings formed in the molds.

In all embodiments of the preparation method for producing the anode sections, the mold cavity or cavities are of a configuration and shape which correspond to that of the anode segment desired and of the predetermined maximum arc length previously disclosed herein.

DETAILED DESCRIPTION OF THE DRAWINGS

Figure 1:
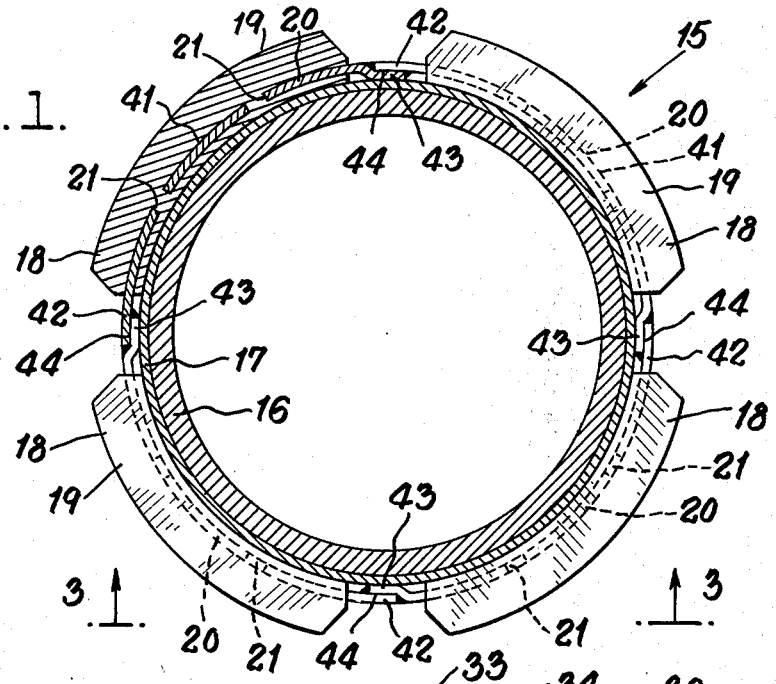
FIG. 1 is a transverse section through the anode of the present invention taken along line 1—1 of FIG. 4 with one anode segment shown in section.
Figure 3:
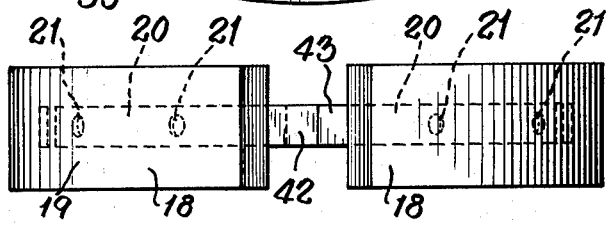
FIG. 3 is a view taken on line 3—3 of FIG. 1.
Figure 4:
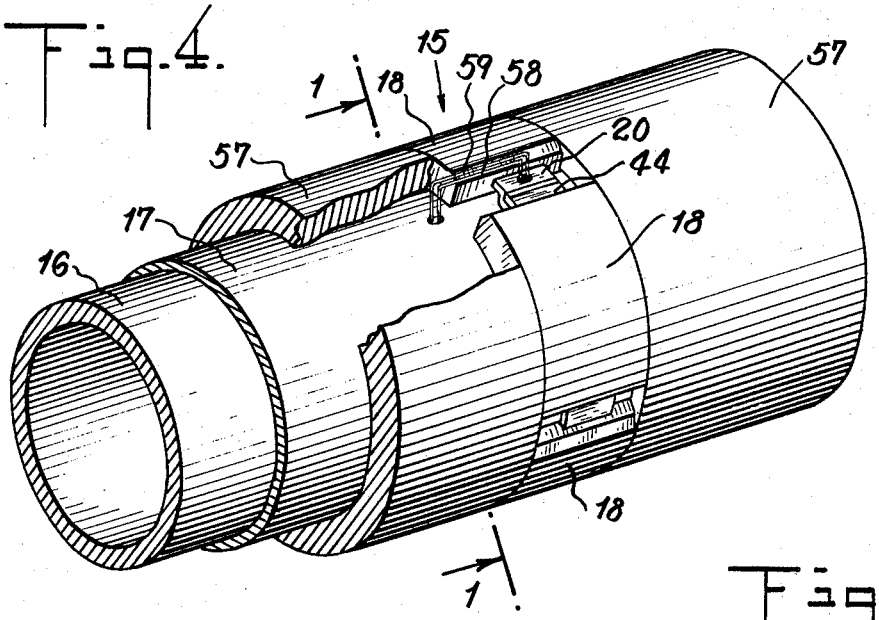
FIG. 4 is a perspective view, partially broken away, showing the anode of the present invention installed on a pipeline, the pipeline also having a negative buoyancy-providing coating of concrete.
Figure 7:
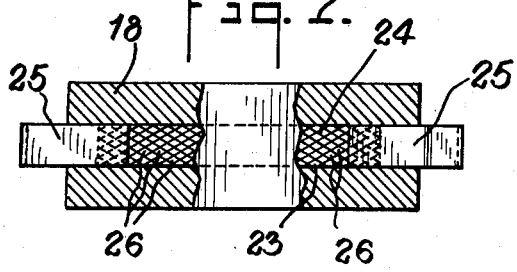
FIG. 7 is a top plan view partially broken away through an anode segment and its core in accordance with another embodiment of the invention.
Figure 8:
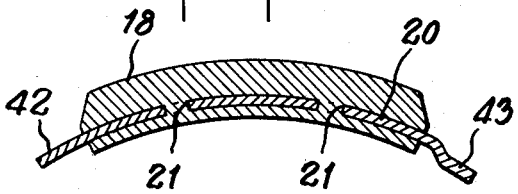
FIG. 8 is a longitudinal section through the anode segment and its core of FIG. 1.
Figure 9:
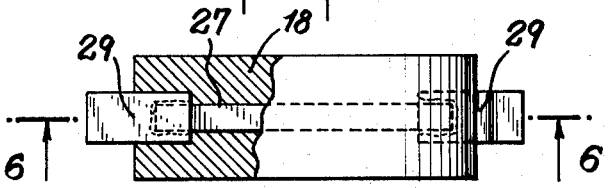
FIG. 9 is a top view partially broken away showing the anode segment and its core of FIG. 6.

With reference to FIGS. 1 and 4, anode 15, secured about ferrous metal pipe 16 of a pipeline having a continuous anti-corrosive coating 17, for example of coal tar enamel, thereover includes arcuate-shaped or substantially arcuate-shaped segments 18 of sacrificial anode metal. As shown in FIG. 1, there are 4 of the anode segments 18 in the embodiment of the invention, the segments are substantially identical in size, shape and structure and each are of shorter length than semicylindrical length. Each anode segment 18 comprises a solid, one piece body 19 of any suitable sacrificial anode metal, e.g. zinc, magnesium, aluminum, or alloys thereof. Each anode segment 18 also includes core bar 20 of a metal cathodic to the anode metal, e.g. steel. The major axes of the cores or core bars herein are in a plane which is normal to the major axis of the pipe. The intermediate portion 41 of core bar 20 and the major portion of this core bar is concentrically or substantially concentrically embedded entirely within anode segment 18, and the end portions 42 and 43 of the core bar project from the opposite ends of segment 18 for forming joints with the core bar end portions 42 and 43 projecting from the opposite ends of immediately adjacent anode segments 18. The end portion 43 of the core bar 20 of each anode segment 18 is offset laterally for receiving in overlapping relationship the non-offset end portion 42 of each core bar 21 of the immediately adjacent anode segment. The overlapping core bar end portions 42 and 43 are welded together to form joint elements 44 which connect and secure the anode segments 18 together closely about the pipe in pipe-embracing relationship thereto. As shown in FIG. 4, pipe 16 is encased in layer 57 of concrete over anti-corrosive coating 17 on each lateral side of anode 15. The concrete layers 57 can be applied to the pipe after the anodes have been installed about the pipe and the cores electrically grounded to the pipe, by cables 58 and 59 secured to the end portion of the core bar or bars and the metal of pipe 16 by thermit welding or brazing. Alternatively, the concrete layers can be applied to the pipe before installation of the anodes by leaving a gap of suitable width between the spaced apart concrete layers, then installing the anodes about the pipe and electrically grounding the cores to the pipe as disclosed immediately above, followed by filling in with concrete any space between the original concrete layers and the anodes. The gap between the opposing ends of the anode segments may also be filled with concrete. The concrete provides desired negative buoyancy besides additional protection for the pipe when the pipe is to be submerged in a body of water, e.g. a body of sea water, lake or river. Concrete layers 57 may be omitted when the pipe is to be installed in the ground and not in a body of water or if the negative buoyancy and additional protection is not desired. Core 20, shwon also in FIGS. 3 and 8, has spaced-apart apertures 21 extending through the bar and communicating one side of the bar with the opposite side thereof. Anode metal is solidified continuously through apertures 21 which aids in anchoring bar 20 within the anode segment. Instead of two apertures 21, core bar 20 can, if desired, have more than two apertures, e.g. three spaced-apart apertures, extending through the core bar for aiding in anchoring the bar 20 within the anode. Also core bar 20 can have but one aperture, if desired, extending through the bar for the purpose disclosed immediately shown. Core bar 23, shown in FIG. 7, has an intermediate section 24 of expanded steel and end sections welded to opposite ends of intermediate section 24. A multiplicity of orifices or apertures 26 provided by the expanded metal communicate one side of intermediate section 24 with the opposite side thereof, and the solidified anode metal extends continuously through orifices 26 to aid in anchoring core bar 23 in the anode. Intermediate section 24 of the core bar 23 is embedded within the anode metal, and end sections 25, which are free of apertures, protrude from opposite ends of the anode. Another modification of the core bar is shown in FIG.'s 6 and 9 wherein the intermediate section 27 of core bar 28 is thinner than the opposite end sections 29 of such core bar which are thicker. Intermediate section 27 is embedded within the anode and end sections 29 protrude from opposite ends of the anode. Intermediate section 27 is also narrower than the wider end sections 29. The wider as well as thicker end sections 29 serve to facilitate joining by welding to protruding end portions of core bars of the immediately adjacent anode segments.

Figure 2:
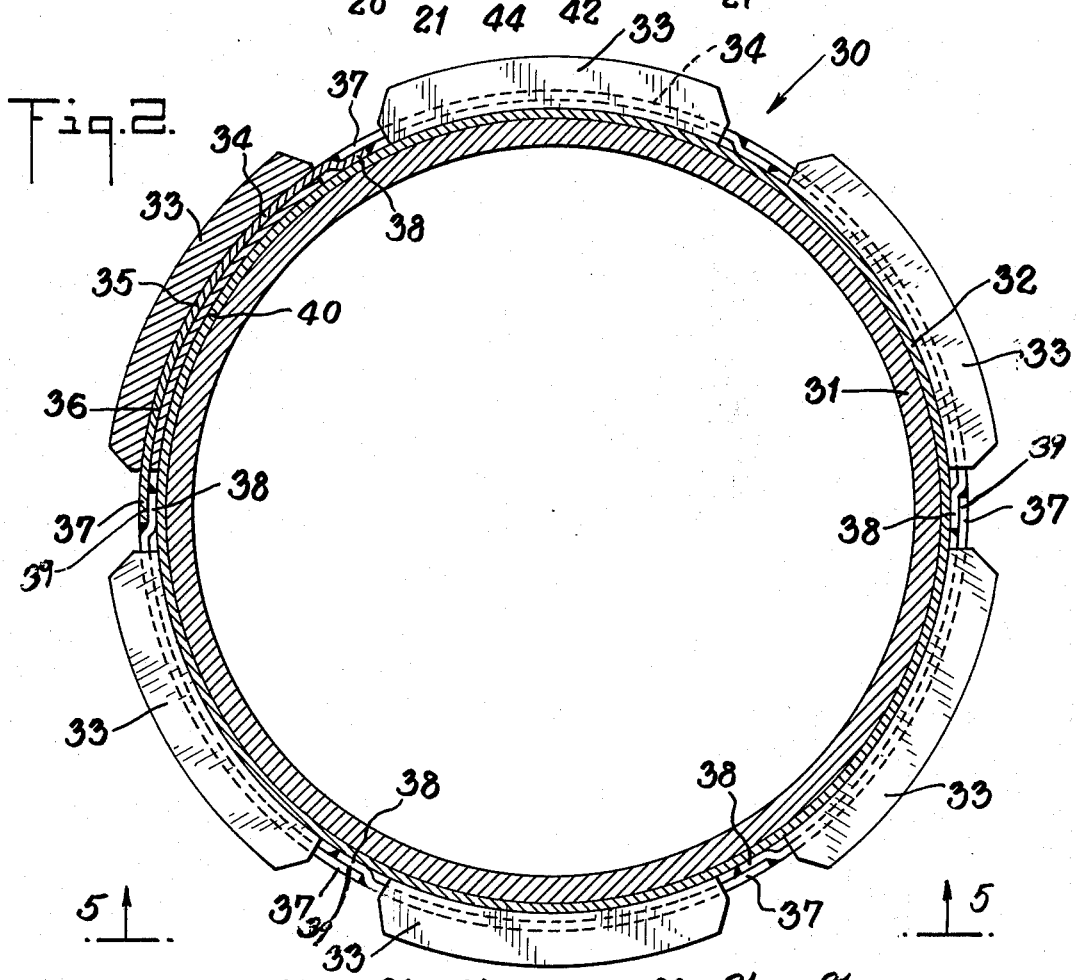
FIGS. 2 is a transverse section through the anode in accordance with another embodiment of the invention with one anode segment shown in section.
Figure 5:
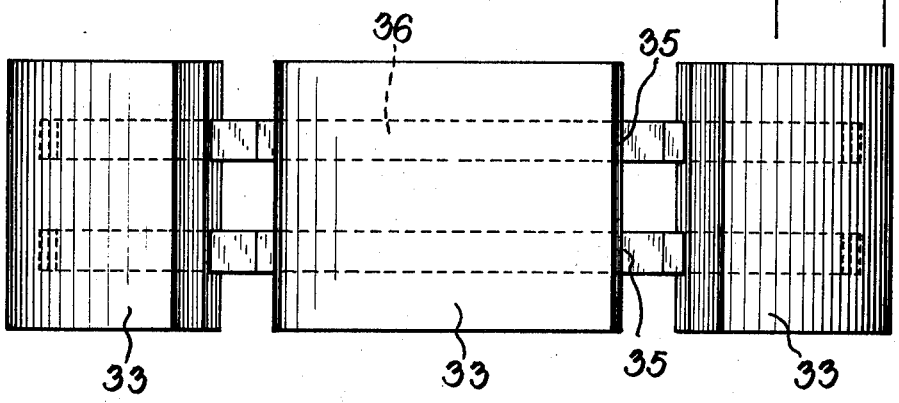
FIG. 5 is a view taken on line 5—5 of FIG. 2.
Figure 6:
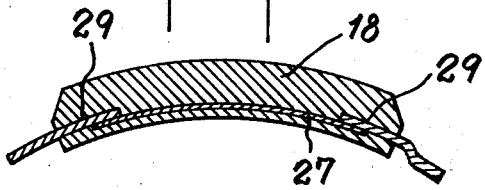
FIG. 6 is a longitudinal section taken on line 6—6 of FIG. 9.

Referring to FIG. 2, in another embodiment of the invention, the anode 30, secured about the larger diameter ferrous metal pipe 31 of a pipeline having a continuous anti-corrosive coating 32 thereover, includes 6 arcuate-shaped or substantially arcuate-shaped segments 33 of sacrificial anode metal. Each anode segment 33 has a solid, one piece body of sacrificial anode metal, and a core 34 comprising two spaced apart, parallel or substantially parallel core bars 35 of steel, shown in FIG. 5. The intermediate portion 36 and the major portion of core bars 35 are concentrically embedded entirely within each anode segment 33 adjacent the inner periphery 40 thereof, with the end portions 37 projecting from opposite ends of segments 33 for forming joints with immediately adjacent anode segments. The end portion 38 of each core bar 35 is offset laterally for receiving in overlapping relationship the non-off-set end portion 37 of each core bar 35 of the immediately adjacent anode segment. The overlapping core bar end portions 37 and 38 are welded together to form joint elements 39 which connect and secure the anode segments 33 together closely about the pipeline in pipe-embracing relationship thereto.

Figure 10:
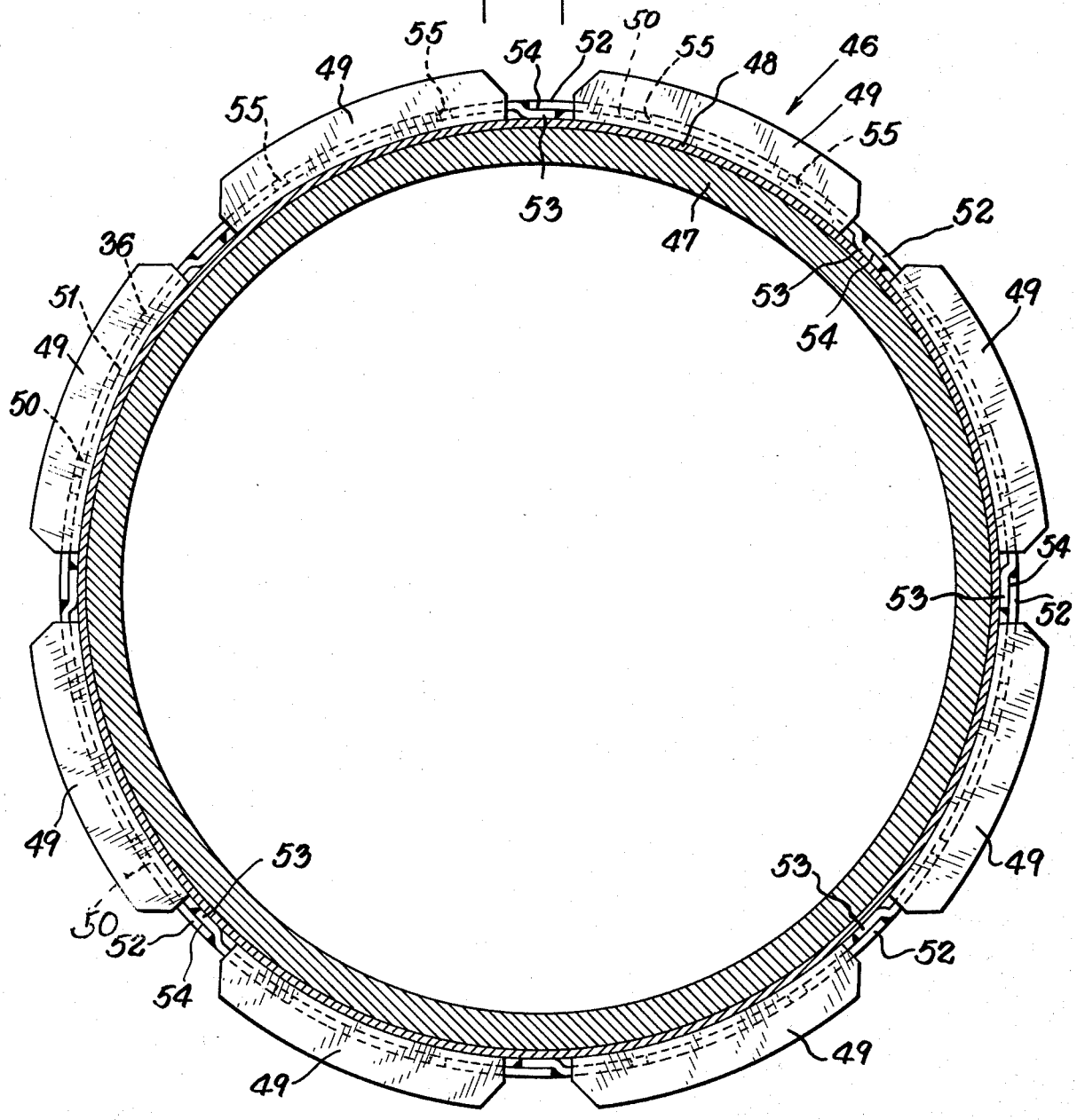
FIG. 10 is a transverse section through the anode in accordance with another embodiment of the invention.

With reference to FIG. 10, in still another embodiment of the invention, the anode 45, secured about ferrous metal pipe 47 of a pipeline of still larger diameter than the pipe of FIG.'s 1 and 2 and having continuous anti-corrosive coating 48 thereover, comprises 8 arcuate-shaped or substantially arcuate-shaped segments 49 of sacrificial anode metal. Anode segments 49 each have a solid, one piece body of sacrificial anode metal, and a core bar 50 of steel. The intermediate portion 51 of core 50 and the major portion of this core is concentrically or substantially concentrically embedded entirely within anode segment 49, and the end portions 52 and 53 of core bar 50 project from opposite ends of segment 49 for forming joints with the core bar end portions 52 and 53 projecting from the opposite ends of immediately adjacent anode segments 49. End portion 53 of each core bar 50 is offset laterally and end portion 52 of each core 50 not offset whereby the offset end portions 53 can be overlapped with the non-offset end portions 52 of the core bar 50, and then welded together to form joint elements 54. The anode segments are thereby connected together and embrace the pipeline. Segments 49 have spaced apart apertures 55 extending through the core bars 50 for facilitating anchoring of bars 50 within the anode segment, the anode metal extending continuously through apertures 55.

Each of the anode segments 18 is shown in FIG. 1, each of the anode segments 33 shown in the FIG. 2 embodiment, and each of the anode segments 49 shown in the FIG. 10 embodiment has an arc length which is less than the predetermined critical maximum arc length, thereby to minimize distortion of the segment during cooling of the metal after casting the segment and to minimize fracturing of the segment during installation of the anode segment about the pipeline.

Referring to FIG.'s 11, 15 and 16, in still other embodiments of the invention, anode 57, secured about ferrous metal pipe 58 of a pipeline having continuous anti-corrosive coating 59, for example of coal tar enamel, thereover includes anode or anode section 60 comprising arcuate-shaped or substantially arcuate-shaped segments 61 of sacrificial anode metal, and continuous metal core or core bar 62 common to and embedded within the anode metal of segments 61. Each anode segment 61 of anode section 60 comprises a solid one piece body 63 of any suitable sacrificial anode metal, e.g. zinc, magnesium, aluminum, or alloys thereof. The core 62 of each anode segment 61 is of a metal cathodic to the anode metal, e.g. steel. Intermediate portions 64 and 65 of the core 62, which together constitue a major portion of the core, are concentrically or substantially concentrically embedded entirely within the anode segments 61. An exposed portion 66 of the core is located between segments 61, and exposed core portion 66 can be of greater or lesser arcuate length than as shown. The end portions 67 and 68 of the core 62 project from opposite ends of the segments 61 of the anode section 60 for forming joints with the core bar end portions 69 and 70 projecting from the adjacent segments. End portion 67 of the core bar of the anode section 60 is offset laterally for receiving in overlapping relationship the non-offset end portion 69 of the core bar of anode segment 72, and non-offset end portion 68 overlaps the offset end portion 70 of the core bar of anode segment 72. The overlapping core bar end portions 67 and 69, 68 and 70 as well as 73 and 74 between arcuate-shaped anode segments 72 are welded together to form joint elements 79, which connect and secure the anode section 60 and the individual anode segments 72 not having the common core together closely about the pipe in pipe-embracing relationship thereto. The two individual arcuate-shaped or substantially arcuate-shaped anode segments 72 shown in FIG. 11 each comprise a solid one piece body 77 of sacrificial anode metal, e.g. zinc, magnesium, aluminum, or alloys thereof, with a separate core or core bar 78 concentrically or substantially concentrically embedded entirely within anode segment 72 and with the end portions of the core bars projecting from the opposite ends of the segment for forming the joint elements as is hereinbefore disclosed. Spaced apart apertures 80 extend through the core bar 62 of anode section 60 for facilitating anchoring of bar 62 within the anode segments 61, the solidified anode metal extending continuously through apertures 80. Spaced apart apertures 81 also extend through each core bar 78 of the individual anode segments 72 also for facilitating anchoring of the core bars within segments 72.

Figure 11:
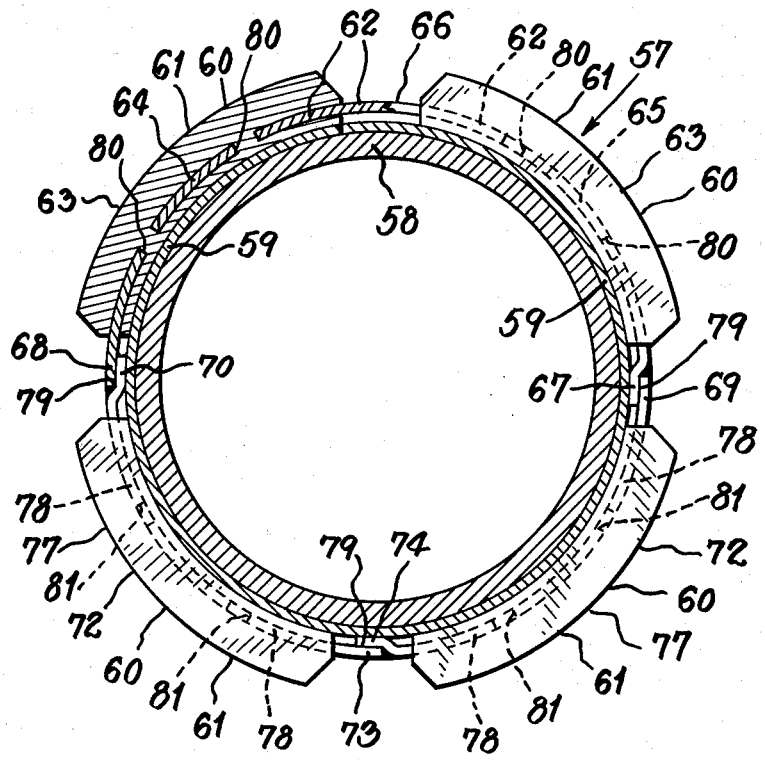
FIG. 11 is a transverse section through the anode in accordance with still another embodiment of the invention with one anode segment shown in section.
Figure 12:
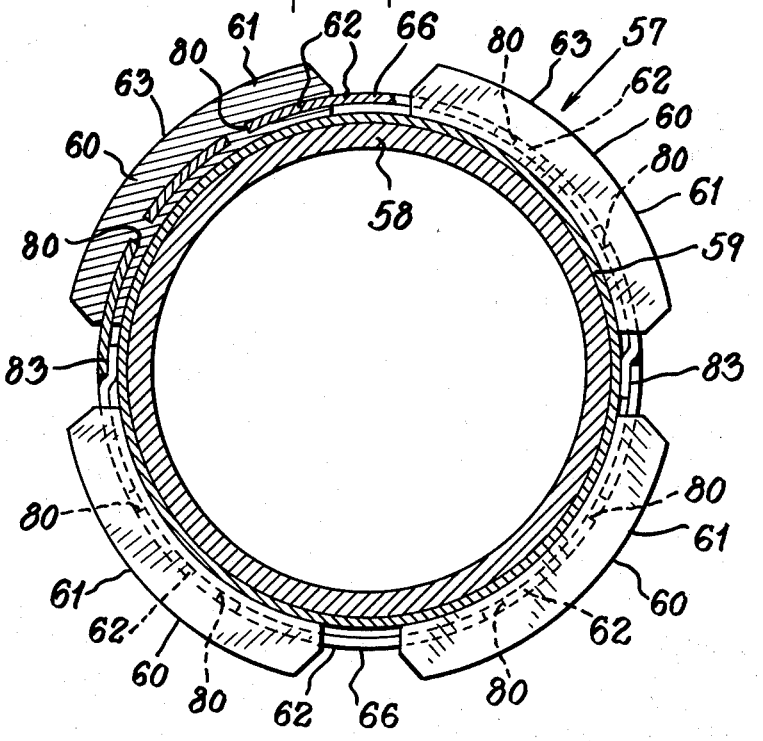
FIG. 12 is a transverse section through an anode assembly in accordance with another embodiment of the invention with one anode segment shown in section.

The anode installation of FIG. 12 differs from that shown in FIG. 11 in that in the installation shown in FIG. 12, two substantially identical anode sections 60 each having a common core or core bar 62 are joined together at joint elements 83 by welding together overlapping end portions of the common core bars 62.

Figure 13:
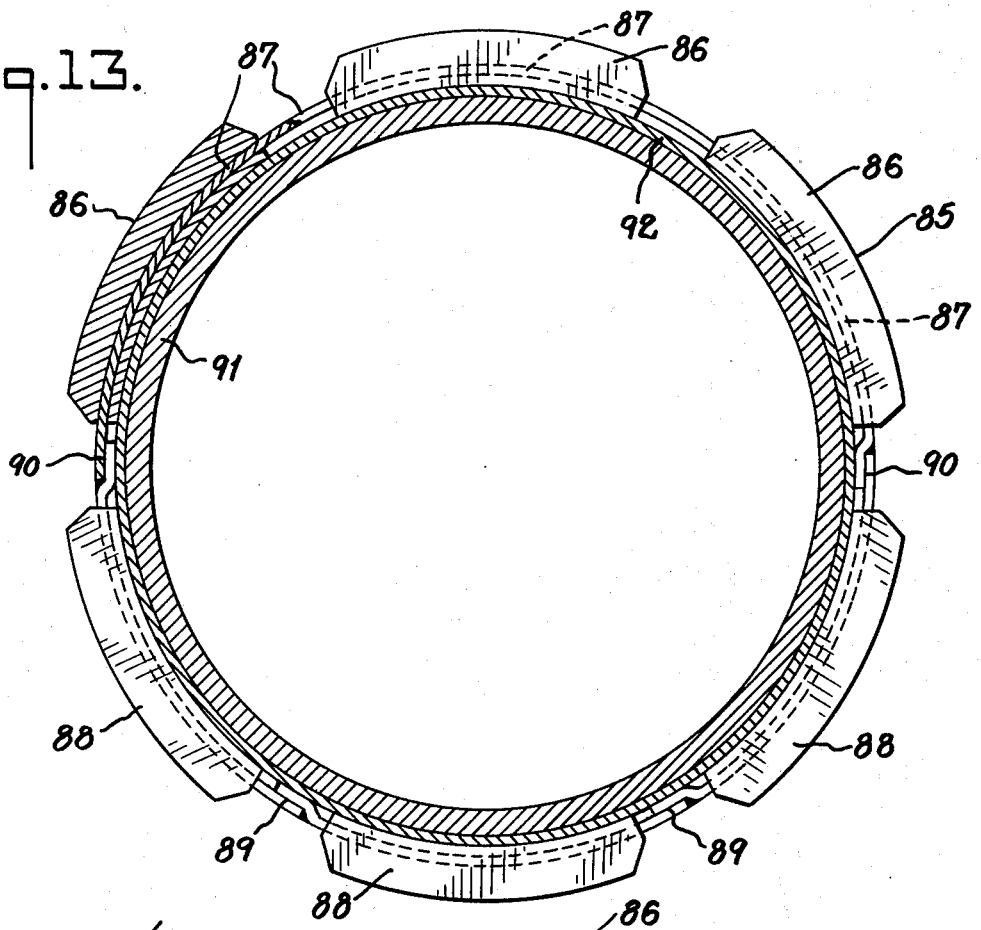
FIG. 13 is a transverse section through another modification of the anode of the embodiment of FIG. 11 with one anode segment shown in section.
Figure 17:
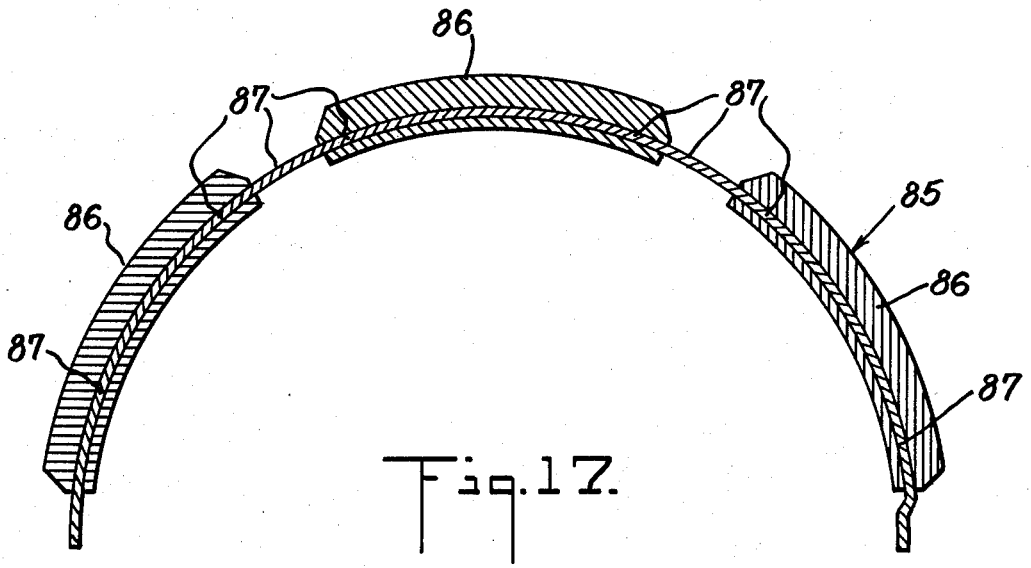
FIG. 17 is a longitudinal section taken on line 17—17 of FIG. 18.
Figure 18:
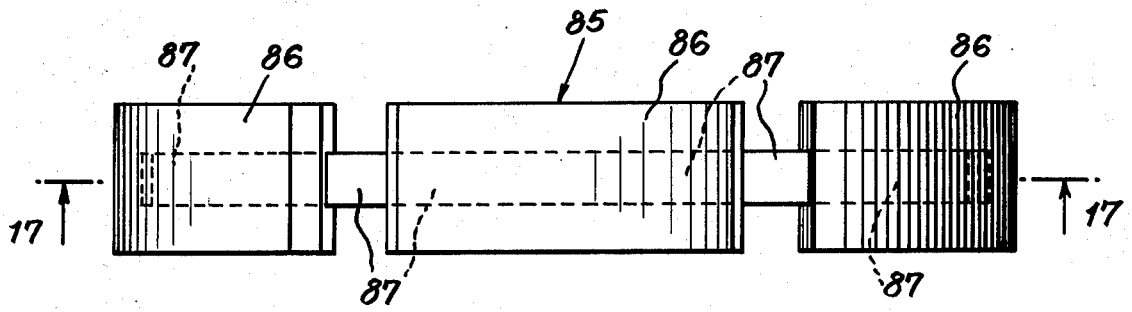
FIG. 18 is a top plan view showing the anode and its common core of FIG. 17.

The anode installation shown in FIG. 13 is substantially the same as that shown in FIG. 11 except that in the embodiment of FIG. 13, the anode section 85, which is shown also in FIGS. 17 and 18, includes three anode segments 86 having the continuous core bar 87 common to all the segments 86. Also, in the FIG. 13 embodiment, three of the individual arcuate-shaped anode segments 88 are joined together with each other and with anode section 85 about the pipe by welding of their overlapping core bar end portions to form joint elements 89 and 90 respectively. Pipe 91 of the FIG. 13 embodiment, as shown, is also of larger diameter than the pipe of FIG. 11. Continuous anti-corrosive coating, for example of coal tar pitch, is designated at 92.

Figure 14:
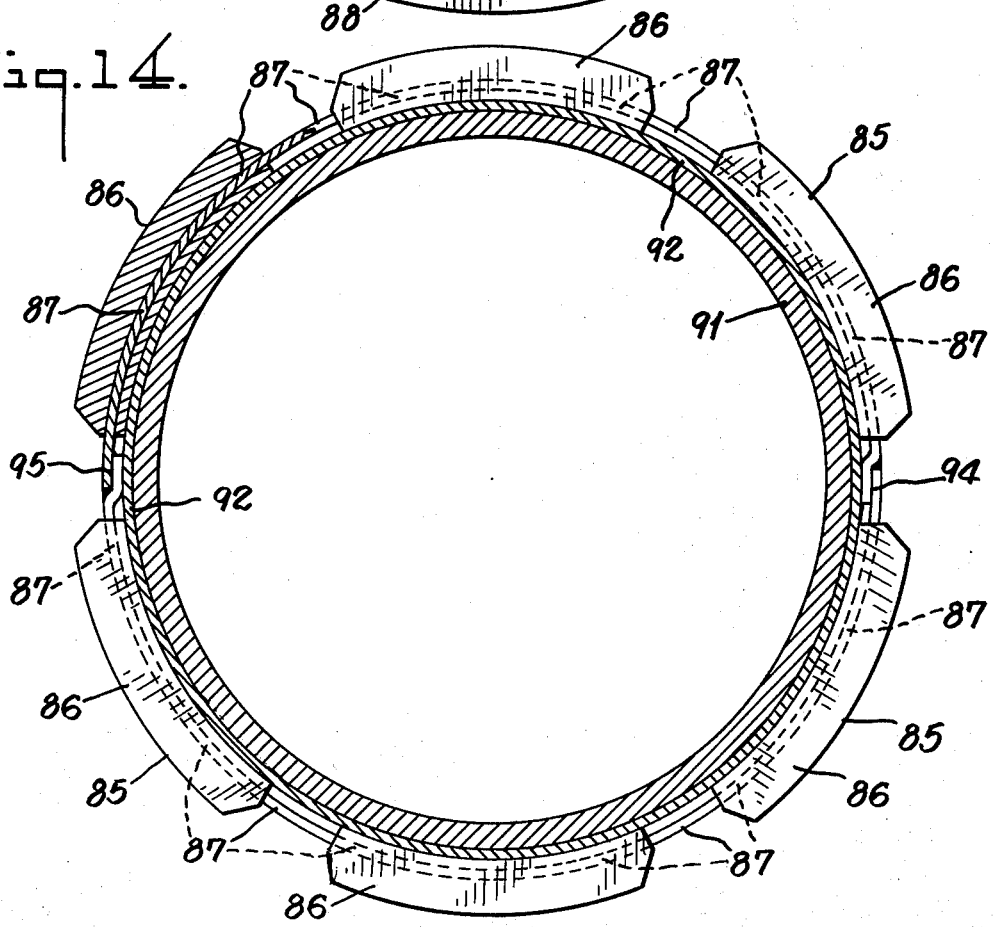
FIG. 14 is a transverse section through an anode assembly in accordance with a further embodiment of the invention with one anode segment shown is section.
Figure 15:
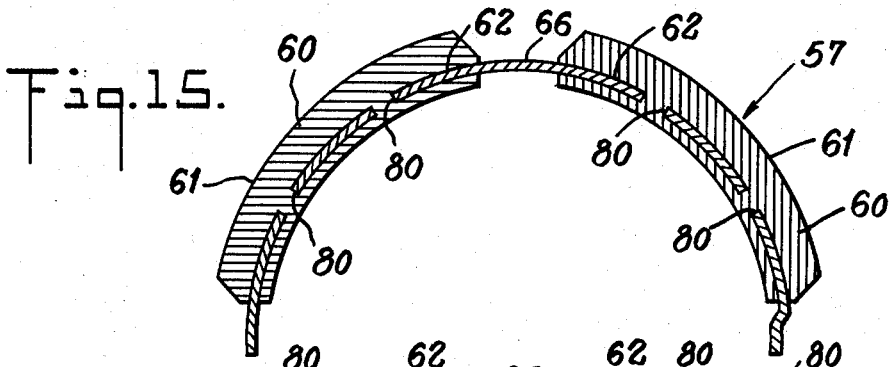
FIG. 15 is a longitudinal section taken on line 15—15 of FIG. 16.
Figure 16:
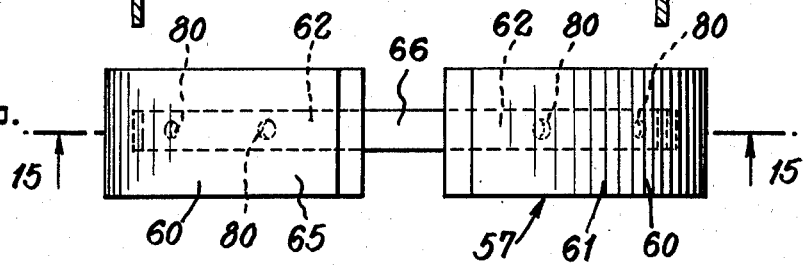
FIG. 16 is a top plan view showing the anode and its common core of FIG. 15.

The anode installation shown in FIG. 14 is substantially the same as that shown in FIG. 12 except that in the FIG. 14 embodiment, the two anode sections 85 each include the three anode segments 86 having continuous core bar 87 common to all the segments 86. Anode sections 85 are joined together with one another about the pipe by welding of their overlapping core bar end portions to form joint elements 94 and 95.

Figure 19:
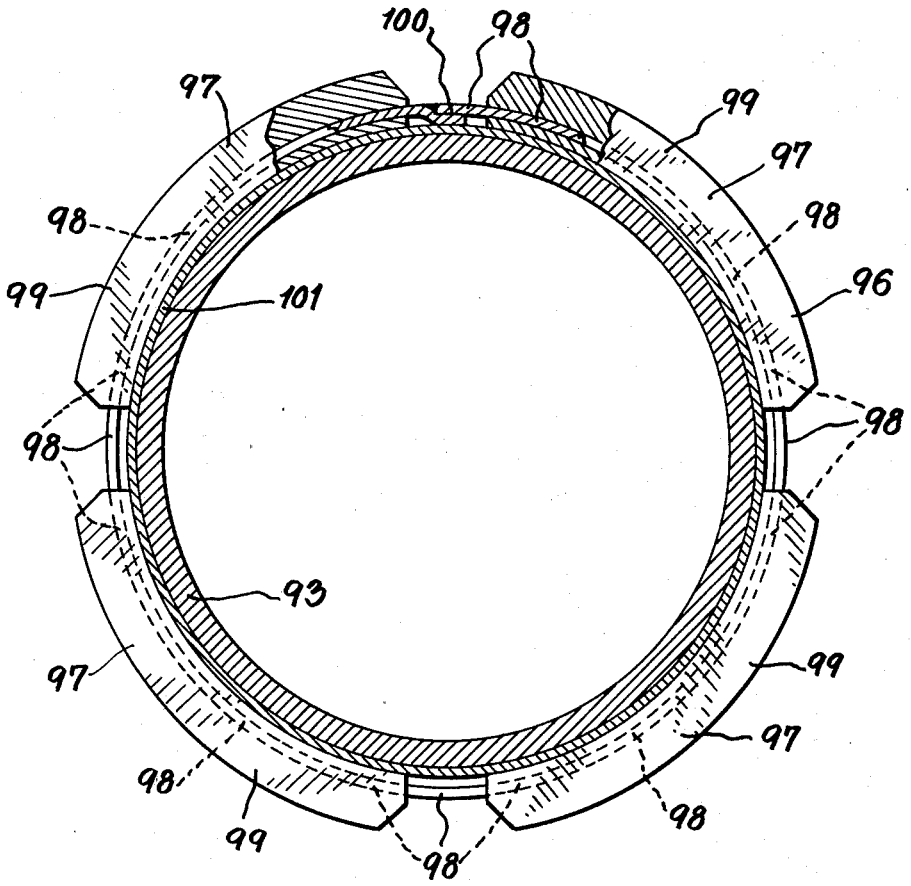
FIG. 19 is a transverse section through the anode in accordance with an additional embodiment of the invention with two anode segments shown partially in section.

The anode installation shown in FIG. 19 differs from that shown in FIG.'s 11, 12, 13 and 14 in that in the FIG. 19 installation, a single anode section 96 has four arcuate-shaped or substantially arcuate-shaped anode segments 97 of sacrificial anode metal and a continuous core bar 98 common to all the segments 97. A major portion of common core bar 98 is concentrically or substantially concentrically embedded entirely within the anode segments, with a minor portion of the core bar 98 not being embedded in segments 97 but being exposed between the spaced apart end portions of segments 97. Each anode segment 97 comprises a solid, one piece body 99 of any suitable sacrificial anode metal, e.g. zinc, magnesiu, aluminum or alloys thereof. Common core 98 is of a metal cathodic to the anode metal, e.g. steel. Anode section 96 is secured about pipe 93 by welding of its overlapping core bar end portions to form joint element 100. Continuous anti-corrosive coating, e.g. of coal-tar pitch, is designated at 101.

DESCRIPTION OF THE PREFERRED EMBODIMENTS

I prefer to employ also the following ratios and relationships:

a. a ratio of the thickness of each anode segment to the pipe diameter in the range of about 1:5 to about 1:15 for pipelines of pipe diameter in the range of about 20 inches to about 36 inches, and such ratio of segment thickness to pipe diameter in the range of about 1:10 to about 1:20 for pipelines of pipe diameter in the range of about 37 inches; and/or b. a ratio of the width of the anode segment to the width of the anode core or total width of the anode cores when more than one core per anode segment is utilized in the range of about 2:1 to about 5:1, when at least 50% of the length of that portion of the core or cores embedded in the anode metal has a width of about 1 inch or greater and a thickness of about 3/16th inch or greater; and/or c. a thickness of the core of the anode segment, or of each core of the anode segment when more than one core per segment is employed, in the range of about 3/16th inch to about 7/16th inch when at least 50% of the length of that portion of the core or cores which is embedded in the anode metal has a width of about 1 inch or greater. More preferably I prefer to employ at least two or ratios or relationships (a), (b) and (c) set forth immediately above, and still more preferably all three of such ratios and relationships (a), (b) and (c).

The present invention is especially well suited for use when the sacrificial anode metal of the anode segments is zinc or a zinc base alloy, inasmuch as the fracturing and cracking problem, which is overcome by this invention, is an especially serious problem when the anode metal is zinc or a zinc base alloy, e.g. a zinc base alloy containing aluminum and cadmium, with or without silicon, and a zinc base alloy containing aluminum, with or without silicon, or unalloyed high purity zinc.

The following examples further illustrate the invention but are not intended to be restrictive thereof.

EXAMPLE I

A bracelet-type anode including four so-called quarter circle arcuate anode segments of a zinc alloy is installed about a pipeline coated with coal tar enamel and wherein the pipeline has a pipe diameter of 20.25 inches. Overlapping end portions of steel core bars which protrude from the ends of immediately adjacent segments are welded together in installing the anode about the pipeline. Each anode segment has an arc length of 14 inches and a thickness of 2.25 inches which is a ratio of thickness of the anode segment to the pipe diameter of 1 to 9 respectively. Each anode segment has one core bar. The arcuate, non-distorted anode segments fit closely about the coated surface of the pipeline and no significant pressure application for bending is required at the end portions of the anode segments during the installation on the pipeline. Consequently, no fracturing of the anode segment occurs during the installation on the pipeline. Further, no distortion of the anode segment occurs during cooling of the anode segment after casting.

EXAMPLE II

A bracelet-type anode including four so-called "quarter circle" arcuate anode segments of a zinc alloy is installed about a pipeline coated with coal tar enamel and wherein the pipeline has a pipe diameter of 18.32 inches. Installation of the anode about the pipeline is carried out by welding together overlapping end portions of a steel core bar protruding from the ends of each immediately adjacent segment. Each anode segment has an arc length of 12.4 inches, a width of 6.25 inches, and a width of the single steel core bar of 2 inches, which is a ratio of the width of the anode segment to the width of the core bar of about 3.13 to 1. The arcuate non-distorted anode segments fit closely about the coated surface of the pipeline, and no signification pressure application for bending is required at the end portions of the anode segments during the installation on the pipeline. As a result, no fracturing of the anode segments occurs during the installation on the pipeline. No distortion of the anode segment occurs during cooling after casting the segment.

EXAMPLE III

There is installed about a pipeline coated with a coal tar-epoxy coating composition a bracelet-type anode including four so-called quarter circle arcuate anode segments of a zinc alloy. The pipeline has a diameter of 37.25 inches. Installation of the anode about the pipeline is carried out by welding together overlapping end portions of steel core bars protruding from opposite ends of immediately adjacent segments. Each anode segment has an arc length of 27 inches, and a thickness of each of the two steel core bars of ¼ inch. The arcuate non-distorted anode segment fits closely about the coated surface of the pipeline and no sifnificent pressure application for bending is required at the end portions of the anode segment during the installation on the pipeline. Consequently, no fracturing of the segments occurs during the installation on the pipeline. No distortion of the anode segments occurs during cooling after casting the segment.

EXAMPLE IV

A bracelet-type anode including six arcuate anode segments of a zinc alloy is installed about a pipeline coated with coal tar enamel and wherein the pipe of a diameter of 49 inches. Overlapping end portions of steel core bars which protrude from each end of immediately adjacent anode segments are welded together in installing the anode about the pipeline. Each segment had two spaced-apart core bars with spaced apart holes in each core bar through which the anode metal had solidified. Each anode segment has an arc length of 23.75 inches, and a thickness of 3.5 inches which corresponds to a ratio of thickness of the anode segment to pipe diameter of 1 to 14. The arcuate, non-distorted anode segments fit closely about the coated surface of the pipeline and no significant pressure application for bending is required at the end portions of the anode segments during the installation on the pipeline. Consequently, no fracturing of the anode segment occurs during the installation on the pipeline. Further, no distortion of the anode segment occurs during cooling of the anode segment after casting.

EXAMPLE V

A bracelet-type anode including two arcuate anodes or anode sections is installed about a pipeline coated with coal tar enamel, and wherein the pipeline has a diameter of 20.25 inches. Each arcuate anode section consists of two arcuate anode segments of a zinc alloy cast on a steel core bar, which core bar is common to both anode segments, with the adjacent ends of the anode segments being spaced apart from each other about 1½ inches on the core bar. The arc length of the core bar of each anode section is about one-half the outer circumference of the enamel-coated pipe. Overlapping end portions of the steel core bars which protrude from the opposite ends of immediately adjacent anode segments of each anode section are welded together in installing the anode about the pipeline. Each anode segment of each anode section has an arc length of 14 inches and a thickness of 2.25 inches, which is a ratio of the thickness of the anode segment to the pipe diameter of 1 to 9. The arcuate, non-distorted anode segments of each anode section fit closely about the coated surface of the pipeline, and no pressure application for bending is required at the end portions of the anode segments during the installation of each anode section on the pipeline. Consequently, no fracturing of the anode segments occurs during the installation of each anode section on the pipeline. The core bar, where exposed between the anode segments, can be bent, if required, to provide a better fit of the anode section to the pipeline. Further, no significant distortion of the anode segments occurs during cooling of the segments of each anode section after casting.

EXAMPLE VI

A bracelet-type anode including one arcuate anode section and two so-called quarter circle arcuate anode segments of a zinc alloy is installed about a pipeline coated with coal tar enamel and wherein the pipeline has a diameter of 37.25 inches. The arcuate anode section consists of two arucate anode segments of a zinc alloy cast on two steel core bars, which core bars are common to both anode segments, with the adjacent ends of the anode segments being spaced apart from each other about 2 inches on the core bars. The two core bars of the anode section are arcuate in shape, and substantially parallel to each other. The arc length of each core bar of the anode section is about one-half the outer circumference of the enamel coated pipe. Overlapping end portions of the steel core bars which protrude from the opposite ends of the anode segments of the anode section and from the opposite ends of the individual anode segments (i.e., not cast on common cores) are welded together in installing the anode about the pipeline. Each anode segment of each anode section, and each individual anode segment i.e., not cast on common cores, has an arc length of about 27 inches and a thickness of 3.44 inches, which is a ratio of the thickness of the anode segment to the pipe diameter of 1 to 10.8. The arcuate, non-distorted anode segments of the anode section, and the individual anode segments (i.e., not cast on the common cores), fit closly about the coated surface of the pipeline and no significant pressure application for bending is required at the end portions of the anode segment or of the individual anode segments not cast on the common cores, during the installation of the anode section and individual anode segments on the pipeline. Consequently, no fracturing of the anode segments of the section or of the individual anode segments occurs during the installation of the anode section and anode segments on the pipeline. Further, no distortion of any of the anode segments occurs during cooling after casting of segments of the anode section or during cooling after casting of the individual anode segments not cast on the common cores.

EXAMPLE VII

A bracelet-type anode including two arcuate anodes or anode sections is installed about a pipeline coated with coal tar enamel, and wherein the pipeline has a diameter of 49 inches. Each arcuate anode section consists of three arcuate anode segments of a zinc alloy cast on two steel core bars, which core bars are common to all three anode segments, with the adjacent ends of the anode segments being spaced apart from each other about 2 inches on the core bars. The two core bars of each anode section are arcuate in shape and substantially parallel to each other. The arc length of each core bar of each anode section is about 79 inches. Overlapping end portions of the steel core bars which protrude from the ends of immediately adjacent anode segments of each anode section are welded together in installing the anode about the pipeline. Each anode segment of each anode section has an arc length of about 23.7 inches and a thickness of 3.5 inches, which is a ratio of the thickness of each thickness of each anode segment to the pipe diameter of 1 to 14. The arcuate, non-distorted anode segments of each anode section fit closely about the coated surface of the pipeline, and no significant pressure application for bending is required at the end portion of the anode segments during the installation of each anode section on the pipeline. Consequently, no fracturing of the anode segments occurs during the installation of the anode segments on the pipeline. Further, no distortion of the anode segments occurs during cooling of the segments of each anode section after casting.

What is claimed is:

1. A cathodic protection assembly comprising a corrosible metallic pipeline having a diameter in the range of about 20 inches to about 72 inches disposed in an electrolyte, a sacrificial bracelet-type anode secured about the pipeline in pipe-embracing relationship thereto, the anode comprising an even-numbered plurality in the range of 4 to 8 arcuate-shaped anode segments of sacrificial anode metal connected about the pipeline in pipe-embracing relationship thereto, said plurality of anode segments being 4 anode segments for a pipeline of pipe diameter in the range of about 20 inches to about 36 inches, 6 anode segments for a pipeline diameter in the range of about 30 inches to about 54 inches, 8 anode segments for a pipeline of pipe diameter in the range of about 40 inches to about 72 inches, 4 or 6 anode segments for a pipeline of pipe diameter in the range of about 30 inches to about 36 inches, and 6 or 8 anode segments for a pipeline of pipe diameter in the range of about 40 inches to about 54 inches, each anode segment comprising at least one metal core cathodic to the anode metal concentrically embedded entirely with the anode metal except for portions of the core extending from opposite end of the anode segment, the anode segments being directly connected together in pipe-embracing relationship by at least one joint formed at end portions of the core, and means for minimizing fracturing of the anode segments during installation of the anode and distortion of the anode segments during cooling of the metal after casting, the anode segment fracturing-and distortion-minimizing means being a predetermined maximum arc length of each anode segment in the range of about 14 inches to about 27 inches, the ratio of the thickness of each anode segment to the pipe diameter being in the range of about 1:5 to about 1:15 for a pipe diameter in the range of about 20 inches to about 36 inches, and said ratio of segment thickness to pipe diameter being in the range of about 1:10 to about 1:20 for a pipe diameter in the range of about 37 inches to about 72 inches, the ratio of the width of the anode segment to the width of the anode core or total width of the anode cores when more than one per anode segment is utilized being in the range of about 2:1 to about 5:1.

2. The anode assembly of claim 1 wherein the maximum arc length of each anode segment is determined by the formula:

$$\text{Maximum arc length of anode segment} = \frac{\pi D}{n} - 2''$$

wherein D is the diameter of the pipeline in inches and n is the total number of anode segments in the assembly.

3. The anode assembly of claim 1, wherein the thickness of the core of the anode segment or of each code of the anode segment when more than one core per segment is employed is in the range of about 3/16th inch to about 7/16th inch.

4. The anode assembly of claim 1 wherein the at least one metal core cathodic to the anode metal is a continuous core common to a plurality of the arcuate-shaped anode segments, the common core being concentrically embedded within the anode metal of the anode segments.

5. The anode assembly of claim 4 wherein the continuous common core is concentrically embedded within the anode metal of at least two anode segments.

6. The anode assembly of claim 4 wherein the continuous common core is concentrically embedded within the anode metal of two or four anode segments.

7. The anode assembly of claim 4 wherein the sacrificial anode metal is metallic zinc.

8. A cathodic protection assembly comprising a corrosible metallic pipeline having a diameter in the range of about 20 inches to about 72 inches disposed in an electrolyte, a sacrificial bracelet-type anode secured about the pipeline in pipe-embracing relationship thereto, the anode comprising an even-numbered plurality in the range of 4 to 8 arcuate-shaped anode segments of sacrificial anode metal connected one to another about the pipeline in pipe-embracing relationship thereto, said plurality of anode segments being 4 anode segments for a pipeline of pipe diameter in the range of about 20 inches to about 36 inches, 6 anode segments for a pipeline of pipe diameter in the range of about 30 inches to about 54 inches, 8 anode segments for a pipeline of pipe diameter in the range of about 40 inches to about 72 inches, 4 or 6 anode segments for a pipeline of pipe diameter in the range of about 30 inches to about 36 inches, and 6 or 8 anode segments for a pipeline of pipe diameter in the range of about 40 inches to about 54 inches, each anode segment comprisng at least one metal core cathodic to the anode metal concentrically embedded entirely within the anode metal except for end portions of the core extending from opposite end edges of the anode segment, the anode segments being directly connected together one to another in pipe-embracing relationship by joints formed at end portions of the core, and means for minimizing fracturing of the anode segments during installation of the anode and distortion of the anode segments during cooling of the metal after casting, the anode segment fracturing-and distortion-minimizing means being a predetermined maximum arc length of each anode segment in the range of about 14 inches to about 27 inches, the ratio of the thickness of each anode segment to the pipe diameter being in the range of about 1:5 to about 1:15 for a pipe diameter in the range of about 20 inches to about 36 inches, and said ratio of segment thickness to pipe diameter being in the range of about 1:10 to about 1:20 respectively for a pipe diameter in the range of about 37 inches to about 72 inches, the ratio of the width of the anode segment to the width of the anode core or total width of the anode cores when more than one core per anode segment is utilized is in the range of about 2:1 to about 5:1.

9. The anode assembly of claim 8 wherein the maximum arc length of each anode segment is determined by the formula:

$$\text{Maximum arc length of anode segment} = \frac{\pi D}{n} - 2''$$

wherein D is the diameter of the pipeline in inches and n is the total number of anode segments in the assembly.

10. A sacrificial anode for cathodic protection of a pipeline or the like comprising an even-numbered plurality in the range of 4 to 8 arcuate-shaped anode segments of sacrificial anode metal adapted to be connected about a corrosible metallic pipeline having a diameter in the range of about 20 inches to 72 inches in pipe-embracing relationship thereto, each anode segment comprising at least one metal core cathodic to the anode metal embedded entirely within the anode metal except for portions of the core extending from opposite end edges of the anode segment, the anode segments adapted to be directly connected together in pipe-embracing relationship by at least one joint formed at end portions of the core, and means for minimizing fracturing of the anode segments during installation of the anode about the pipeline and distortion of the anode segments during cooling of the metal after casting, the anode segment fracturing-and distortion-minimizing means being a predetermined maximum arc length of each anode segment in the range of about 14 inches to about 27 inches, the ratio of the width of the anode segment to the width of the anode core or total width of the anode cores when more than one core per anode segment is utilized being in the range of about 2:1 to about 5:1, the thickness of the core of the anode segment or of each core of the anode segment when more than one core per segment is employed being in the range of about 3/16th inch to about 7/16th inch.

11. The anode of claim 10 wherein the maximum arc length of each anode segment is determined by the formula:

$$\text{Maximum arc length of anode segment} = \frac{\pi D}{n} - 2''$$

wherein D is the diameter of the pipeline in inches and n is the total number of anode segments in the assembly.

12. A sacrificial anode for cathodic protection of a pipeline or the like comprising an even-numbered plurality in the range of 4 to 8 arcuate-shaped anode segments of sacrificial anode metal adapted to be connected one to another about a corrosible metallic pipeline having a diameter in the range of about 20 inches to 72 inches in pipe-embracing relationship thereto, each anode segment comprising at least one metal core cathodic to the anode metal embedded entirely within the anode metal except for portions of the core extending from opposite end edges of the anode segment, the anode segments adapted to be directly connected together one to another in pipe-embracing relationship by joints formed at end portions of the core, and means for minimizing fracturing of the anode segments during installation of the anode about the pipeline and distortion of the anode segments during cooling of the metal after casting, the anode segment fracturing-and distortion-minimizing means being a predetermined maximum arc length of each anode segment in the range of about 14 inches to about 27 inches, the ratio of the width of the anode segment to the width of the anode core or total width of the anode cores when more than one core per anode segment is utilized being in the range of about 2:1 to about 5:1, the thickness of the core of the anode segment or of each core of the anode segment when more than one core per segment is employed being in the range of about 3/16th inch to about 7/16th inch.

13. The anode of claim 12 wherein the maximum arc length of each anode segment is determined by the formula:

$$\text{Maximum arc length of anode segment} = \frac{\pi D}{n} - 2''$$

wherein D is the diameter of the pipeline in inches and n is the total number of anode segments in the assembly.

* * * * *

UNITED STATES PATENT OFFICE
CERTIFICATE OF CORRECTION

Patent No. 3,994,795 Dated November 30, 1976

Inventor(s) George W. Kurr

It is certified that error appears in the above-identified patent and that said Letters Patent are hereby corrected as shown below:

Page 1, in the ABSTRACT, second column, 4th line up from the bottom; column 4, line 28; column 16, line 8; column 17, line 14; column 18, line 5; and column 18, line 43; the formula should read:

--Maximum arc length of anode segment = $\frac{\pi D}{n}$ - 2 inches--.

Column 4, line 37, "any of" should read --of any--. Column 5, line 14, "of" (first occurrence) should read --or--. Column 7, line 39, "FIGS." should read --FIG.--; line 55, --plan-- should be inserted after "top" and before "view". Column 9, line 5, "shwon" should read --shown--. Column 11, line 55, "magnesiu" should read --magnesium--. Column 12, line 5, --to about 72 inches-- should be inserted after "inches" and before the semi-colon. Column 13, line 35, --is-- should be inserted after "pipe" and before "of". Column 14, line 26, "arucate" should read --arcuate--. Column 15, line 14, "of each thickness" should be deleted; line 19, "portion" should read --portions--; line 40, --of pipe-- should be inserted after "line" and before "diameter"; line 50, --edges-- should be inserted after "end" and before "of". Column 16, line 30, "or" should read --to--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*